US005580391A

United States Patent [19]

Franco et al.

[11] Patent Number: 5,580,391

[45] Date of Patent: Dec. 3, 1996

[54] PROCESS FOR THE THERMO-CHEMICAL CLEANING OF STORAGE TANKS

[75] Inventors: Zadson d. Franco, Aracaju; Carlos N. Khalil, Governador; Oswaldo d. Pereira, Jr., Jaearepagua, all of Brazil

[73] Assignee: Petroleo Brasileiro S.A. - Petrobras, Rio de Janeiro, Brazil

[21] Appl. No.: 322,414

[22] Filed: Oct. 13, 1994

[30] Foreign Application Priority Data

Oct. 15, 1993 [BR] Brazil ..... 9304238

[51] Int. Cl.[6] ..... B08B 7/00; B08B 9/00; C23G 1/00; F23J 1/00

[52] U.S. Cl. ..... 134/5; 134/19; 134/20; 134/22.1; 134/22.11; 134/22.12; 134/22.13; 134/22.14; 134/22.16; 134/22.17; 134/22.18; 134/22.19; 134/26; 134/28; 134/29; 134/34; 134/35; 134/36; 134/40

[58] Field of Search ..... 134/22.1, 22.16, 134/22.17, 22.18, 22.19, 26, 28, 34, 40, 5, 19, 20, 22.11, 22.12, 22.13, 22.14, 29, 35, 36

[56] References Cited

U.S. PATENT DOCUMENTS 4,482,016 11/1984 Richardson ..... 166/300
4,846,277 7/1989 Khalil et al. .
5,085,710 2/1992 Goss ..... 134/22.14
5,183,581 2/1993 Khalil et al. ..... 252/8.552

FOREIGN PATENT DOCUMENTS 0032813 1/1981 European Pat. Off. .
58-030398 2/1983 Japan .

OTHER PUBLICATIONS

"Crude oil Tank–Cleaning Process Recovers oil, Reduces Hazardous Wastes," Oil & Gas Journal, Dec. 13, 1993, pp. 35–39; Goss, Davis, Tyler.
"Better ways to clean crude storage tanks and desalters" by J. W. Barnett, Hydrocarbon Processing, Jan. 1980, pp. 82–86.
Discussion of the T.H.O.R. Process, 4 pages.
Discussion of the Super Macs Process, 4 pages.

*Primary Examiner*—Jan H. Silbaugh
*Assistant Examiner*—Robin S. Gray
*Attorney, Agent, or Firm*—Sughrue, Mion, Zinn, Macpeak & Seas

[57] ABSTRACT

A process for the thermo-chemical cleaning of storage tanks which contain sludges from petroleum oil or related products. The process is carried out by the combined action of an organic solvent and the generation of nitrogen gas and heat, whereby produced heating in situ, agitation by turbulence and flotation of the fluidized sludge, which after being collected and transferred to tanks or desalting units can be reintroduced in the usual refining flow.

13 Claims, 2 Drawing Sheets

PROCESS FOR THE THERMO-CHEMICAL CLEANING OF STORAGE TANKS

BACKGROUND OF THE INVENTION

1. Field of the Invention

The present invention relates to the thermo-chemical cleaning of storage tanks used in the oil and related industries, and more specifically, to removing oil sludges from refinery tanks, ship containers or any other storage means for storage and treatment of oil and related products. The new process can equally be used in the removal of oil adsorbed or impregnated on clay or sandy solids such as gravel packing, sands, etc.

2. Prior Art

European patent 032813 describes a process for the removal of sludges from crude or refined oil storage tanks by injecting a dispersing agent into the sludge by means of a water jet. The emulsified oil fractions are removed under pressure and recirculated to the jet. The sludge is physically and chemically altered so that it can be pumped and easily removed from the tank, the emulsion being further mixed to an oil volume sufficient to cause the sludge separation, the water layer being separated and the heavy hydrocarbons recovered.

Japanese publication J 58 030398 describes the treatment of sludges by adding the same amount of solvent and heating by circulating in the oil furnace to extract paraffin waxes and separating solid constituents from the oil fraction.

J. W. Barnett in an article in "Hydrocarbon Processing" issued in January 1980, p. 82–86 entitled "Better Ways to Clean Crude Storage Tanks and Desalters", has described a process for heating sludges by using hot water and emulsifiers in one mode, while another mode uses hot solvent, both modes requiring external means for heating and circulation.

The so-called T.H.O.R. process is a mechanical system for the recovery of hydrocarbons from the oil sludge and contaminated oil tank bottoms. The process involves penetrating the sludge bulk with a hot water circulating system using a submersible pump. The T.H.O.R. process comprises two stages: sludge moving and sludge refining. To render the sludge mobile, water heated with refinery steam is pumped into the tank to lower the viscosity of the sludge so as to optimize its pumping and recovery. The mobile sludge is pumped through a submersible pumping unit placed in the medium to be pumped. The amount of water placed into the tank is equivalent to that of the sludge to be moved. The water is kept circulating during the whole liquification period of the tank contents, which normally takes 7 to 8 days. The pumping process has a maximum flow rate of 15000 liters per hour, the mass being pumped corresponding to a ratio of 50% water/50% sludge. The mixture is pumped through Alfa Laval equipment for the removal of insoluble foreign matter and water so as to produce oil to be reintroduced in the refining process. The recovered product, of BSW lower than 1% and low conductivity is mixed to crude oil in predetermined amounts. The so-called "SUPER-MACS" system developed by Riedel Environmental Technologies Inc. employs heated water jets under high average pressure, in order to melt and heat paraffin and sludge deposits. The prducts are separated and recovered based on their different densities, the oil contained in the sludge also being recovered. Thus, to be effective, the processes described in the literature require heating, agitation, solvent and additives, in separate or combined manner. The process of the present invention provides heating in situ free of any energy expense, agitation generated by turbulence and free of agitators, besides a flotation effect caused by the gaseous nitrogen used, without any requirement for externally added gas. Furthermore, flotation, which is unknown in the processes of the prior art, facilitates stratification.

SUMMARY OF THE INVENTION

The present invention provides a process for the thermo-chemical cleaning of a sludge-contaning storage tank for petroleum oil or a similar material which comprises: adding to said sludge in said tank an organic solvent or mixture of solvents which fluidizes the said sludge, the volume ratio of solvent: sludge being in the range of 0.5:1 to 2.5:1; adding to the mixture of sludge and organic solvent an aqueous nitrogen-generating system comprising a reducing nitrogen salt, an oxidizing nitrogen salt and an acid activator which interact to generate nitrogen and heat, thereby causing thorough mixing of the said sludge, the said solvent, and the said aqueous nitrogen-generating system; allowing the contents of the said tank to separate to form an oil phase consisting essentially of the said solvent and the organic constituents of the said sludge, a saline aqueous phase comprising the residue of the nitrogen generating system, and, if present, the solid inorganic constituents of the said sludge; removing the oil phase and recovering the solvent and other valuable constituents therefrom; removing the aqueous phase and sending it to effluent treatment; and if required removing also any solid inorganic residue remaining in said tank. In this process sludges of crude or refined oil, stored in tanks or any other kind of container, are fluidized and the oil contained therein is recovered by the adition of a solvent having the correct properties to fluidize the sludge, followed by the addition of aqueous solutions of inorganic salts which generate nitrogen and heat. The following effects are obtained:

- the sludge is fluidized, caused by heating, turbulence and the action of the solvent;
- the oil, water and solid phases are stratified by flotation and sedimentation, with separation of the solid and aqueous phases which are duly discarded, while the organic phase is directed to distillation and oil recovery.

An interesting and unexpected benefit to the environment is that any possible sulfide content in the sludge aqueous phase is made to precipitate by contact and reaction with the nitrite ion. The precipitated elemental sulfur can be recovered from this medium. The present invention provides a process for the thermo chemical cleaning of storage tanks by fluidization of the oil sludges in any type of container by addition of the proper solvent followed by an aqueous solution of inorganic salts which generate nitrogen and heat. The resulting heating, turbulence, fluidization, flotation and sedimentation cause separation of the oil, water and solid phases. The oil contained in the sludge is recovered so as to render the process as economical as possible. The process is environmentally friendly, i.e. it is conservative to the human health because of the absence of contact with organic vapors, and to the environment because of the absence of toxic discharges, such as in land-farming, which cause undesirable infiltrations in the ground and water reservoirs, and atmospheric contaminations. Industrial safety is preserved because the use of nitrogen avoids the build up of explosive mixtures with light hydrocarbons contained in the sludge. The new process is self-powered, i.e., the oil sludges are fluidized by heating in situ with agitation by means of turbulence. The generated nitrogen gas causes flotation of the organic phase, and, therefore, great energy savings which render the process highly recommended as regards the environment. In the process the gas generation causes spontaneous flotation of the heated and melted sludge which is then solubilized as it contacts the solvent.

BRIEF DESCRIPTION OF THE DRAWINGS

In the accompanying drawings.

PREFERRED MODE

Figure 1:
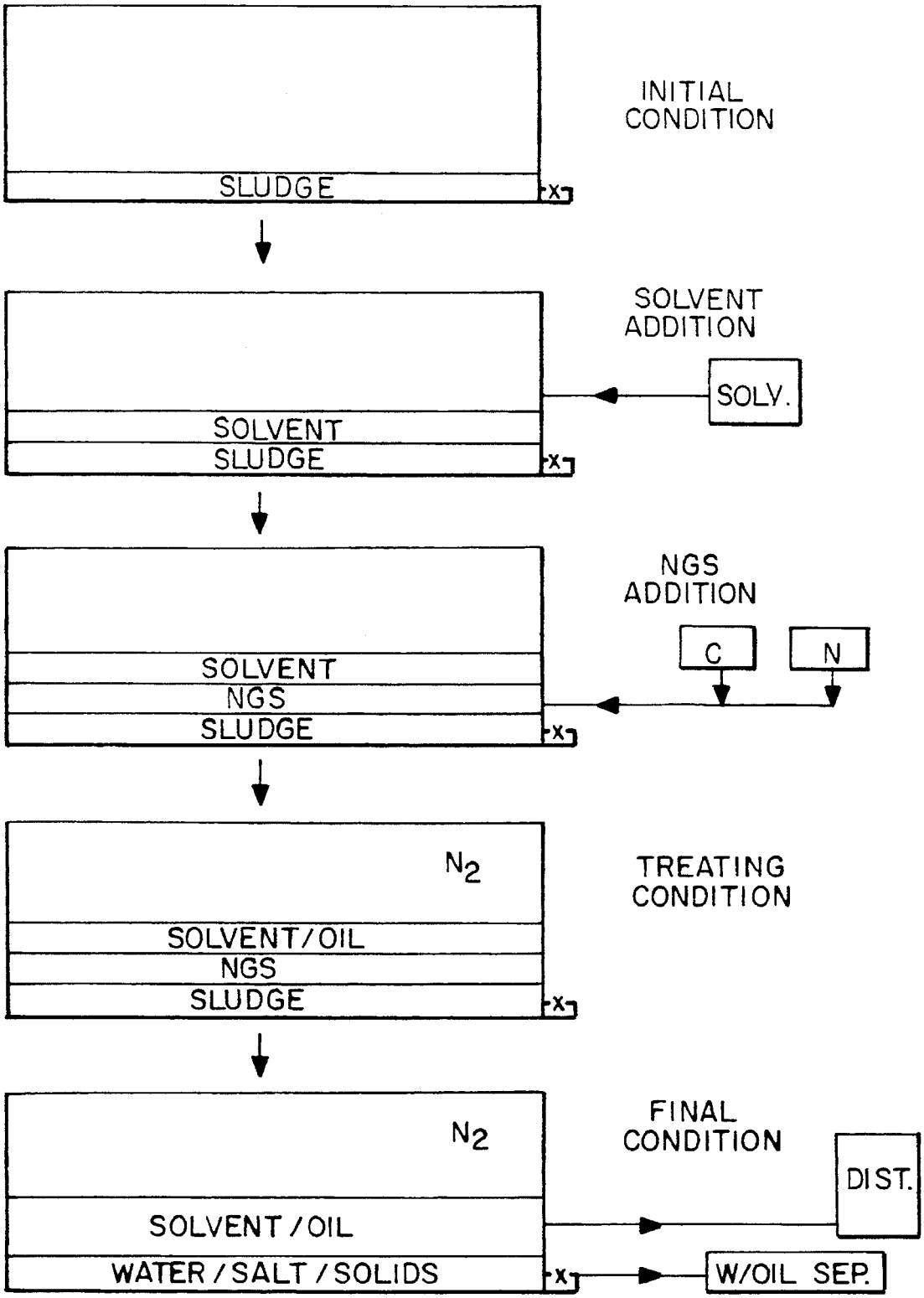
FIG. 1 is a simplified flowsheet of the process of the present invention, indicating the initial condition of the sludge containing tank, the solvent addition and the simultaneous addition of salt solutions which generate nitrogen and create turbulence, heating and sludge flotation caused by the consequent nitrogen gas generation, and further separation and recovery of the oil and the added solvent.
Figure 2:
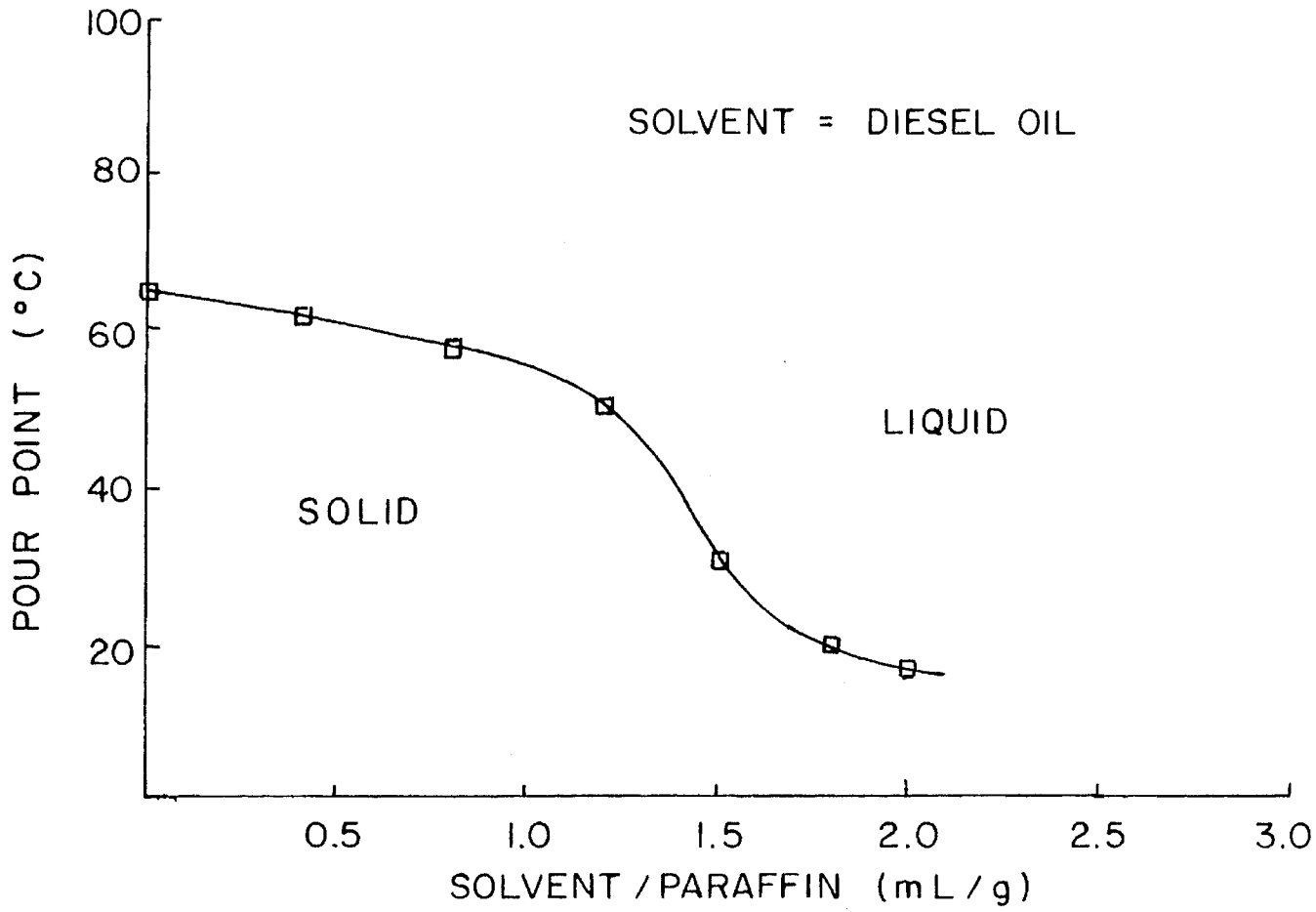
FIG. 2 is a plot showing the relationship between the melt temperature in degrees Centigrade of the sludge of Example 1 and the volumetric ratio solvent/sludge. It can be seen that, at room temperature, the sludge will be in the molten state when the solvent/sludge ratio is near 1.5/1.

The process of the present invention may be applied to any sludge of crude oil or its fractions or of any petroleum products which are stored in stationary or movable tanks, and in any treating equipment such as mud separators belonging to treating stations such as OTS (Oil Treating Station) and ETS (Effluent Treating Station) of any size or capacity where paraffin sludge deposits could occur. Preferably the supernatant oil is withdrawn by any kind of pump available in the unit, the process being then effected on the semi-solid sludge present in the tank bottom. The amount of sludge sometimes reaches up to 10% or more of the overall tank volume. Adequate sampling of the hydrocarbon species and any other compounds present in the sludge indicates the pure or mixed organic solvent which will best achieve dissolution of the paraffin deposit. It is well known that oil sludges are made up of variable amounts of compounds such as paraffins, asphaltenes, resins and carboids, besides water, clay and silica. For example, paraffins are soluble in aliphatic solvents, while the preferred solvent for asphaltenes are the aromatic solvents. Mixtures of aliphatic and aromatic solvents can be used. A solvent having a high flash point is preferred in order to avoid potential hazardous solvent losses during the generation of nitrogen and heat.

The aqueous solutions of nitrogen salts which are combined in the presence of acetic acid to produce the heat and turbulence which are required to cause the desired fluidization, are basically as described and claimed in U.S. Pat. No. 4,846,277, U.S. Pat. No. 5,183,581, all in the name of the applicants and hereby fully incorporated as reference. In these applications, although the nitrogen and heat are generated by the same pair of nitrogen reagents, the operational details in each application distinguish it from the others as well as from the prior literature.

The process of the present invention thus involves the contact of an aqueous solution of a reducing nitrogen salt in an equimolar ratio to an aqueous solution of an oxidizing nitrogen salt. The reducing nitrogen salt is preferably ammonium chloride or ammonium sulfate, this latter being cheaper and more soluble. Generally, the oxidizing nitrogen salt is sodium nitrite.

The volumetric ratio of the solvent used to the sludge to be fluidized may be in a relatively broad range. However, for economic reasons it is preferred to use solvent/sludge ratios between 0.5/1 up to 2.5/1, preferably 1.1/1 up to 2/1. The NGS/sludge is normally 0.05/1 up to 0.25, preferably 0.1/1 up to 0.2/1.

It is preferred to add initially the solvent and then the nitrogen and heat generating solution.

The catalyst for the reaction which generates nitrogen and heat is a weak organic acid such as acetic acid, used in an amount between 0.3 to 2.0% by volume based on the volume of the reducing nitrogen salt solution.

The present invention is useful in cases of sludge formation in oil storage tanks wherein the sludge fills parts of the tank, for example between 3 an 10% of the volume, the remainder being liquid oil which can be pumped out and transferred elsewhere.

To perform the new process, the storage tank must be provided with means for draining off the nitrogen gas formed by the chemical reaction, this draining means being situated preferably on the roof of the tank. The minimum necessary diameter of the draining hole necessary for the nitrogen gas escape can be calculated as a function of the volume of nitrogen gas generated.

The first recommended procedure in the proces of the present invention is to withdraw from the storage tank or container the supernatant oil which is pumped and transferred to a reserve tank. The subsequent steps which constitute the process of the invention comprise:

sampling and analysing the sludge in order to determine its chemical composition so as to choose the most suitable organic solvent (or mixture of organic solvents) for the fluidization of the sludge;

in suitable mixers, preparing solutions of reducing nitrogen salt (ammonium chloride or ammonium sulfate) and oxidizing nitrogen salt (generally sodium nitrite) in equimolar stoichiometry, the amount in a volume basis being nearly 2/1 of oxidizing salt/reducing salt. As the dissolution reaction of the reactants is endothermal, it is recommended, during the preparation of the said solutions, to use a heating coil, usually readily available in refineries and other units;

checking in a field bench scale laboratory the most suitable amount of acid catalyst for the reaction of nitrogen generation. This amount is found by adding pre-determined amounts of acid to the mixture of samples of the freshly prepared solutions, while evaluating the delay necessary to trigger the reaction, and the temperature at which the reaction begins. The optimum situation is a temperature of 80° C. 10 minutes after the acid addition;

transferring to the tank the previously calculated volume of solution for the sludge fluidization, the ratio of solvent/sludge on a volume basis being generally from 0.5/1 up to 2.5/1;

heating the tank contents (where heating means exist) with a heating coil to between 50° and 65° C. for two to four days and setting in the tank mixers (if there are any) to cause previous dilution of the sludge so as to reduce the amount of heat needed for heating the medium. Thus, energy delivered through the nitrogen generation reaction can be optimized so as to heat the medium up to near 75° C. at the end of the treatment;

separately transferring the nitrogen salt solutions to tank trucks wherefrom the solutions will be pumped after displacement and connection of same to the upper entrance of the storage tank;

after adding the catalyst, pumping equimolar amounts of solutions of the nitrogen and heat generating salts into the sludge-containing tank, the treatment being effected until the sludge is fluidized, optionally with mechanical agitation;

in order to facilitate the withdrawal of the oil phase from the storage tank or other storage means, adding a sufficient amount of an industrial water bed which is positioned below the oil phase;

gradually transferring the oil phase to crude tanks or desalting units;

gradually transferring the aqueous phase of high salinity to treating systems for aqueous effluents; and optionally opening the entrance door of the storage tank to withdraw any inorganic solid residues (e.g. sand, clay, rust, etc). The present invention is illustrated by the following Example.

EXAMPLE 1

This Example illustrates the thermo-chemical cleaning of sludges from oil storage tanks carried out in the facilities of a Refinery situated in the county of Duque de Caxias, Rio de Janeiro, Brazil. The working of the operation program for cleaning a crude oil storage tank of nominal capacity 32,000 cubic meters was based on field data, on chemical and physico-chemical characterization of the sludge aiming at the selection of the best organic solvent, and on process bench simulation. Also, a simplified mathematical model for the prediction of the thermal balance during the tank treatment was used as described below.

The crude storage tank under study had the following characteristics:

| | | |
|---|---|---|
| DIMENSIONS: | Internal Diameter | 55 meters |
| | Overall height | 15.0 meters |
| | Operational height | 13.5 meters |
| | Tank area | (volume by height) 2374 $m^3/m$ |
| | Capacity | 32,000 $m^3$ |
| FACILITIES: | Fixed roof provided with holes | |
| | Agitator blades on the sidewalls | |
| | Reating coils | |
| | Level indicator | |
| | Entrance door | |
| CONTENTS: | Light Arabian oil | |
| SLUDGE: | Type | paraffin wax (80%) |
| | Height | 52 cm |
| | Volume | 1236 $m^3$ |
| | Density | 810 $kg/m^3$ |
| | Weight | 1,000 tons |
| | Pour point | 67° C. |
| | Specific heat | 0.52 kcal/kg. °C. |

From pour point tests on the sludge in the presence of the organic solvents available in the refinery, that is, light naphtha, heavy diesel oil and kerosene, heavy diesel oil was demonstrated to be the best solvent for the particular sludge under test. It was employed as sludge diluent in a volumetric amount higher than 2/1 (diesel/sludge).

Once the best diluent and the correct volume proportions of solvent/sludge have been established, the mathematical model can be applied to establish volume and NGS concentration to be employed in the tank treatment, as follows. In the equation below, solution C is an ammonium chloride solution of 6 moles per liter of solution, while solution N is a sodium nitrite solution of 9 moles per liter of solution.

$$V\,ngs = \frac{C\,\text{sludge} \times (T\,bal - To) \times d\,\text{sludge} \times V\,\text{sludge}}{\Delta H\,\text{reaction} \times c\,sgn \times f\,\text{reaction} - C_{ngs} \times (T\,bal - To) \times d_{ngs}} \quad \text{Eq. (1)}$$

wherein

V ngs=NGS volume (cubic meters)

C ngs=NGS specific heat (kcal/kg. °C.)

c ngs=NGS concentration (mol/liter)

ngs=NGS bulk density (kg/cubic meter)

ΔH reaction=NGS reaction heat (kcal/mol)

f reaction=NGS reaction factor (mol %)

V sludge=sludge volume (cubic meters)

C sludge=sludge specific heat (kcal/kg. °C.)

T sludge=sludge bulk density (kg/cubic meter)

T bal=Temperature at balance (°C.)

T o=Initial Temperature (°C.)

By applying data from the storage tank, the sludge and the NGS to Equation (1), the optimum NGS volume to be used in the treatment is:

$$V_{ngs} = \frac{0.52 \times (50 - 25) \times 810 \times 1236}{75 \times 3 \times 0.75 - 1.0\,(50 - 25) \times 1100} = 82{,}3\ m^3$$

After the supernatant oil is drained away, the working of the tank cleaning operation was as follows:

| | | |
|---|---|---|
| HEAVY DIESEL OIL | 2,500 $m^3$ | Q = 100 $m^3/h$ |
| NGS | | |
| SOL C | 60 $m^3$ | Q = 30 $m^3/h$ |
| SOL N | 30 $m^3$ | Q = 30 $m^3/h$ |
| REACTION TIME | 60 minutes | |
| MAXIMUM TEMPERATURE | 72° C. | |
| WATER BED VOLUME | 2,500 $m^3$ | |

After the completion of the nitrogen generation reaction the tank bottom contained a bed of hot, salt water derived from the spent NGS. Water from the fire defense system was then added to make up a bottom bed, followed by draining the residual oil (fluidized sludge) away to another crude tank and from this to an atmospheric distillation unit where it is processed in the usual way. The highly saline bottoms water is then directed to the effluent treatment station (ETS). The described treatment achieved a performance of more than 90% removal of the original sludge volume present in the storage tank.

Economical analysis shows that the process costs is nearly zero, since the distillation of the recovered sludge and of the added solvent covers costs from inorganic reagents as well as from other expenses.

Therefore, the described process combines the advantages of cost near zero and environmental and human preservation, which makes it extremely interesting.

We claim:

1. A process for thermochemically cleaning a sludge-containing storage tank for petroleum oil, crude oil sludge, fractions of crude oil sludge or petroleum products by removing sludge remaining in the storage tank after removal of supernatant oil from said tank comprising the steps of:

a) determining the chemical composition of the sludge;

b) preparing aqueous solutions of reducing nitrogen salt and oxidizing nitrogen salt in equimolar stoichiometry wherein an amount of reducing nitrogen salt solution to oxidizing salt solution is by volume about 2:1;

c) determining an amount of an acid to be added to the aqueous solution of reducing nitrogen salt;

d) transferring to the sludge-containing storage tank a volume of an organic solvent or a mixture of organic solvents sufficient to substantially fluidize the sludge;

e) pumping the reducing and oxidizing nitrogen salt solutions into the storage tank in equimolar amounts to generate nitrogen and heat sufficient to substantially complete fluidization of the sludge;

f) adding an amount of industrial water sufficient to make a water bed below an oil phase;

g) transferring the oil phase to crude tanks or desalting units;

h) transferring the reducing and oxidizing nitrogen salt solutions to an aqueous effluent treating system; and i) providing a tank which is substantially free of sludge and aqueous phase and thereby safe for personnel to enter.

2. The process according to claim 1 wherein the solvent used to substantially fluidize the sludge is one or more components selected from the group consisting of light naphtha, light petroleum, heavy diesel oil and kerosene.

3. The process according to claim 1 wherein the reducing nitrogen salt is either ammonium chloride or ammonium sulfate and the oxidizing nitrogen salt is sodium nitrite.

4. The process according to claim 1 wherein the acid added to the aqueous solution of the reducing nitrogen salt is acetic acid.

5. The process according to claim 4 wherein the acetic acid comprises from 0.3 to 2.0% by volume of the aqueous reducing nitrogen salt solution.

6. The process according to claim 1 wherein the storage tanks are heated by means of heating coils at temperatures of from 50 to 65 degrees Celsius for two to four days.

7. The process according to claim 6 wherein blade agitators are used in the storage tanks.

8. The process according to claim 1 wherein the organic solvent or the mixture of organic solvents is present in volume amounts of solvent/sludge of from 0.5:1 to 2.5:1.

9. The process according to claim 1 wherein the organic solvent or the mixture of organic solvents is present in ratio volume amounts of solvent/sludge of from 1.1:1 to 2:1.

10. The process according to claim 1 wherein generating said heat and said nitrogen within the storage tank causes heating in situ, agitation by turbulence, and flotation of the fluidized sludge.

11. The process according to claim 10 wherein a ratio by volume of a nitrogen generating system to said sludge is from 0.05:1 to 0.25:1.

12. The process according to claim 11 wherein the ratio by volume of the nitrogen generating system to said sludge is from 0.1:1 to 0.2:1.

13. The process according to any one of claims 1–12 wherein additional water is added.

* * * * *